US006557818B2

(12) United States Patent
Manthci

(10) Patent No.: US 6,557,818 B2
(45) Date of Patent: May 6, 2003

(54) FORM FOR MANUFACTURING CONCRETE RETAINING WALL BLOCKS

(75) Inventor: James A. Manthci, Petoskey, MI (US)

(73) Assignee: Redi-Rock International, LLC, Charlevoix, MI (US)

( * ) Notice: Subject to any disclaimer, the term of this patent is extended or adjusted under 35 U.S.C. 154(b) by 0 days.

(21) Appl. No.: 09/670,924

(22) Filed: Sep. 28, 2000

(65) Prior Publication Data

US 2001/0026734 A1 Oct. 4, 2001

Related U.S. Application Data

(60) Provisional application No. 60/156,889, filed on Sep. 30, 1999.

(51) Int. Cl.[7] ..... B41B 11/52; E02D 29/02; E04C 2/04

(52) U.S. Cl. ..... 249/171; 249/52; 249/176; 249/101; 405/284; 405/286; 52/596; 52/605; 52/425; 52/442; 52/443; 52/436 R

(58) Field of Search ..... 405/262, 284, 405/286; 249/52, 98, 140, 160, 161, 101–104, 170–172, 176, 179; 264/239, 247, 256, 333, 271.1; 425/304, 436 R, 436 RM, 442, 443; 52/100, 596, 604–609; D25/113, 115

(56) References Cited

U.S. PATENT DOCUMENTS

| | | | | | |
|---|---|---|---|---|---|
| 887,814 | A | * | 5/1908 | Johnson | 249/172 |
| 1,534,353 | A | * | 4/1925 | Besser | 264/256 X |
| 1,634,357 | A | | 7/1927 | Himmelright | |
| 1,678,613 | A | | 7/1928 | Weiss | |
| 2,688,245 | A | | 9/1954 | Vesper | 72/41 |
| 4,063,866 | A | * | 12/1977 | Lubiecki | 425/443 X |
| 4,790,508 | A | * | 12/1988 | Henderson et al. | 249/101 X |
| 4,815,897 | A | | 3/1989 | Risi et al. | 405/284 |
| 4,909,717 | A | * | 3/1990 | Pardo | 425/138 |
| 4,992,005 | A | | 2/1991 | Hilfiker | 405/284 |
| 5,062,610 | A | * | 11/1991 | Woolford et al. | 249/52 |
| 5,230,195 | A | | 7/1993 | Sease | 52/593 |
| 5,337,527 | A | | 8/1994 | Wagenaar | 52/169.2 |
| 5,402,609 | A | | 4/1995 | Kelley, Jr. | 52/98 |
| 5,484,236 | A | * | 1/1996 | Gravier | 405/286 |
| 5,490,363 | A | * | 2/1996 | Woolford | 405/284 X |
| 5,589,124 | A | * | 12/1996 | Woolford et al. | 264/333 X |
| 5,647,185 | A | | 7/1997 | Forlini | 52/604 |
| 5,791,827 | A | | 8/1998 | Arvai et al. | 405/286 |
| 5,817,248 | A | * | 10/1998 | Forlini | 249/102 X |
| 6,029,943 | A | * | 2/2000 | Sievert | 249/52 |
| 6,138,983 | A | * | 10/2000 | Sievert | 249/52 |
| 6,178,704 | B1 | * | 1/2001 | Sievert | 52/100 |
| 6,224,815 | B1 | * | 5/2001 | LaCroix et al. | 264/333 |

FOREIGN PATENT DOCUMENTS

| | | | | |
|---|---|---|---|---|
| EP | 433591 | * | 6/1991 | 264/69 |
| GB | 2177313 | * | 10/1983 | 264/225 |

OTHER PUBLICATIONS

Concrete Products, Apr., 2000 issue, cover and pp. 17 and 19.

* cited by examiner

*Primary Examiner*—Jong-Suk (James) Lee
(74) *Attorney, Agent, or Firm*—MacMillan, Sobanski & Todd, LLC

(57) ABSTRACT

A form for manufacturing concrete retaining wall blocks. The blocks are cast in the form with a front face of the block down. A resilient face insert at the bottom of the form imparts an ornamental appearance to the front face of the block. The form has four sides which pivot at their bottom between a closed position for casting a block and an open position which permits removing the cast block from the form. Preferably, the cast block has parallel top and bottom surfaces and angled sides. Sides of the form form a groove in the bottom of the block which extends parallel to and spaced from the front face and form knobs which project above the top of the block for alignment with a grooves on adjacent stacked blocks forming a retaining wall. The block is formed with two lifting points, one for removal of the block from the form and one for moving the block when constructing a retaining wall. Inserts may be attached to the form for casting half blocks, blocks for the top and bottom tiers of a retaining wall, and other block configurations.

22 Claims, 16 Drawing Sheets

FORM FOR MANUFACTURING CONCRETE RETAINING WALL BLOCKS

CROSS-REFERENCE TO RELATED APPLICATIONS

This application claims the benefit of U.S. Provisional Application No. 60,156,889 filed Sep. 30, 1999.

STATEMENT REGARDING FEDERALLY SPONSORED RESEARCH OR DEVELOPMENT

Not Applicable.

BACKGROUND OF THE INVENTION

The invention relates to concrete retaining wall blocks and to a form for manufacturing concrete retaining wall blocks.

Concrete blocks are sometimes used for constructing retaining walls. Generally rectangular blocks have been stacked to form a retaining wall and then back filled on one side to form a terrace. The backfill can exert a sufficient force on the retaining wall blocks to cause the stacked blocks to move out of their original position. In some cases, ground anchors or a geo grid system have been secured to the blocks to increase the stability of the wall. Retaining wall blocks have been stacked to form a stepped wall so that the front face of each row of blocks is offset slightly behind the front face of the adjacent lower row of blocks. According to the prior art, a raised lip has sometimes been formed along the upper edge of the block adjacent the front face to prevent the stepped blocks from sliding out of position, as shown in Arvai et al. U.S. Pat. No. 5,791,827. According to another prior art retaining wall block design, retaining wall blocks have sometimes been formed with a groove extending along a bottom surface parallel to an exposed face of the block and with a raised rib on a top surface. The groove on a stacked block receives the raised rib on the block below for aligning the front faces of the stacked blocks. Such an arrangement is shown, for example, in Forlini U.S. Pat. No. 5,647,185. Retaining wall blocks also may be formed with round knobs on the top surface which fit into a groove on the bottom surface of a stacked block to permit forming a curved retaining wall, as shown in Wagenaar U.S. Pat. No. 5,337,527.

Ready mix concrete companies mix batches of concrete to customers' orders and deliver the mixed concrete in trucks to the customer's construction site. It is customary for a concrete customer to order more concrete than it estimates that it will need for a job so that there will be adequate concrete available to finish the job. When a truck returns to the ready mix company from a delivery, it generally has some left over concrete which must be cleaned from the truck. The left over concrete is sometimes cast into various smaller articles. However, this can be labor intensive.

Ready mix concrete companies often have relatively simple forms for casting blocks from the left over concrete. Typically, the blocks are sufficiently crude in appearance that they are only suitable for forming retaining walls for applications such as for gravel and sand storage and for similar commercial applications. The blocks do not have an appearance which is suitable for constructing retaining walls for residential and upscale commercial applications where an attractive appearance is necessary. Blocks which are not needed are often disposed of in land fills.

It is preferable to pour left over concrete into forms which create usable products which can be sold, such as architecturally acceptable retaining wall blocks, so long as excessive labor is not required.

BRIEF SUMMARY OF THE INVENTION

According to the invention, a form is provided for casting concrete retaining wall blocks. The form is simple to use and produces attractive blocks which can be sold for use in residential and commercial applications.

The retaining wall block form includes a bottom having a resilient face insert which forms a suitable textured front surface or face for the cast block. Therefore the blocks are cast in the form with face down. Four sides of the form are hinged at the bottom to pivot between a closed position and an open position. A locking mechanism holds the sides of the form in the closed position while casting a block. After the concrete block has sufficiently hardened, the locking mechanism is released and the form sides are pivoted away from the block to the open position to free the cast block for removal by lifting vertically from the open form. Removable inserts are attached to the sides of the form to create different types of blocks. For example, inserts may form a groove in a bottom surface of the block and to form one or more knobs in the upper surface of the block. The side of the form which shapes the top of the block also may include resilient inserts which form a recess in the top of cast block and which position a steel wire or rod in the block to extend across the recess. The embedded rod forms a lifting hook for use in moving and stacking the blocks when constructing a retaining wall.

The back surface of the cast block is the top surface of the concrete when poured into the form. One or more sides of the form may include a minimum fill mark for indicating when a minimum acceptable amount of concrete has been poured into the form. The form is sized to accommodate additional concrete since the amount of left over concrete will typically vary with each load. The blocks are designed to stack in tiers with the front faces of the blocks aligned to form a vertical retaining wall or with upper tiers slightly stepped back to form a sloping retaining wall. Differences in depth of the blocks are compensated for by allowing the blocks to extend different depths into the soil or back fill behind the wall. Preferably, a heavy wire loop is embedded into the block to extend above the top surface of the poured concrete in the form (the back surface of the block during use). The wire loop is used for lifting the block from the form after the concrete has hardened and the form is opened. The loop also may be used to secure to optional ground anchors or structural tie-backs to add stability to a retaining wall constructed from the blocks. However, such tie-backs will normally not be needed, unless the wall is quite high or the soil is unstable.

Various objects and advantages of the invention will become apparent from the following detailed description of the invention and the accompanying drawings.

DETAILED DESCRIPTION OF THE INVENTION

Figure 1:
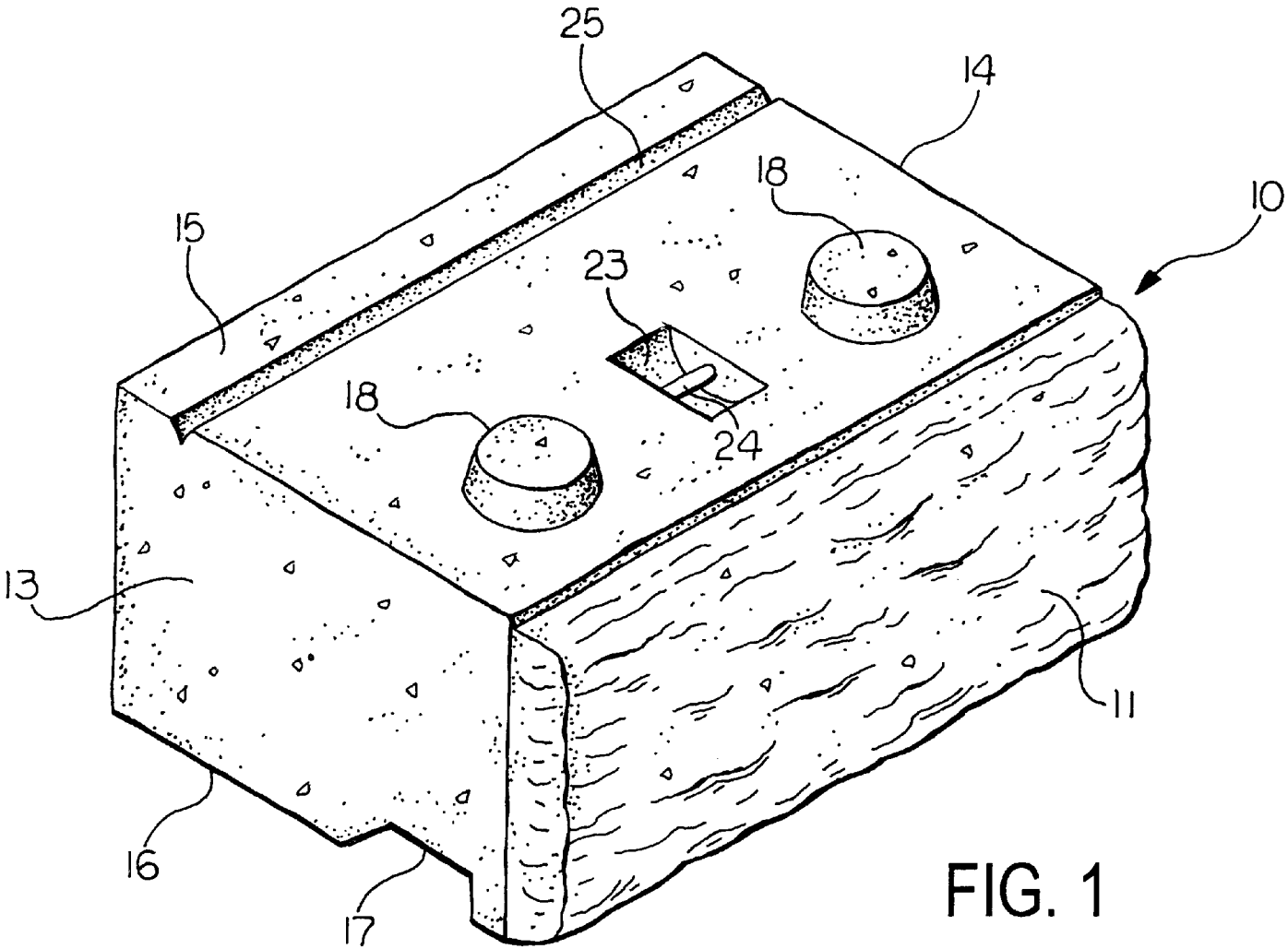
FIG. 1 is a front perspective view of a concrete retaining wall block made with the form of the present invention.

Referring to FIGS. 1–4 of the drawings, a retaining wall block 10 is shown according to the invention. The block 10 has a textured front face 11 which forms the exposed face of a wall constructed with a plurality of the blocks 10. The front 11 may be formed with any desired texture or pattern to provide a desired ornamental appearance. For example, the front face 11 may be configured to simulate granite or another stone. Further, a pigment may be applied to the front face to further improve its appearance. In plan view, the block 10 appears generally as a trapezoid having a rear side 12 which is substantially parallel to the front face 11, and having two angled sides 13 and 14. By angling the sides 13 and 14, adjacent blocks 10 forming a retaining wall may be angled relative to each other to form a curved or serpentine wall. The block 10 also has a top 15 and a bottom 16. When the blocks 10 are assembled into a retaining wall, the top and bottom 15 and 16 are generally horizontal.

Figure 2:
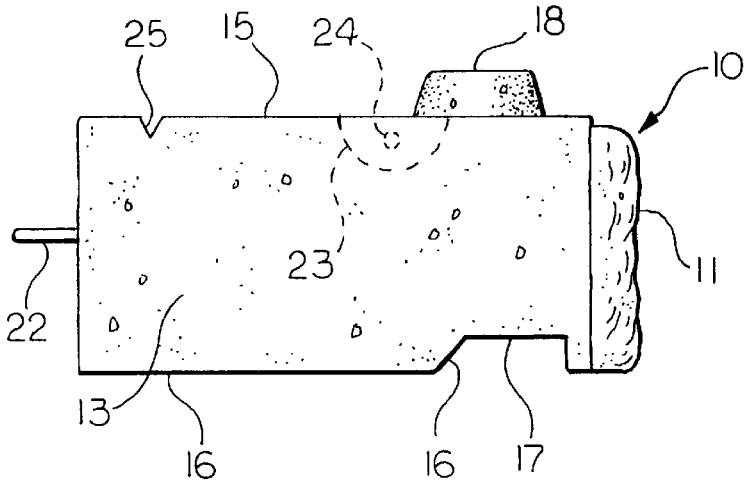
FIG. 2 is a left side elevational view of the retaining wall block of FIG. 1.
Figure 3:
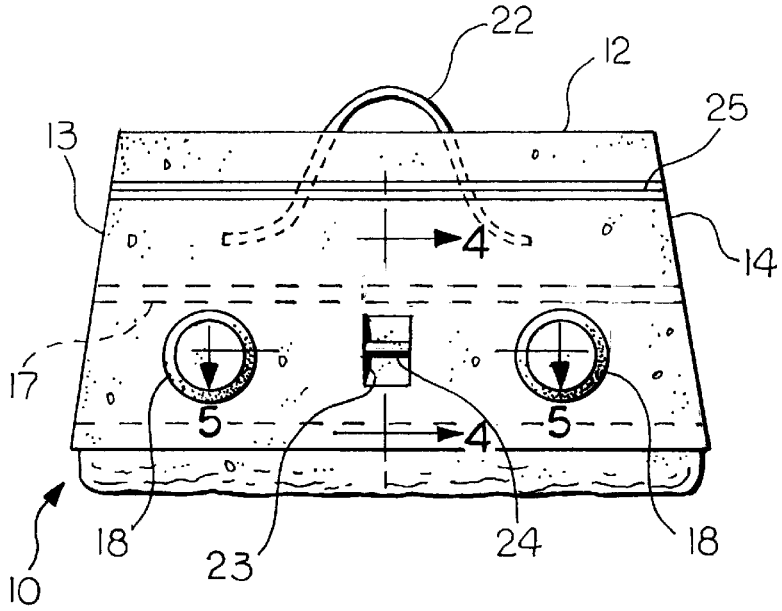
FIG. 3 is a top plan view of the retaining wall block of FIG. 1.
Figure 4:
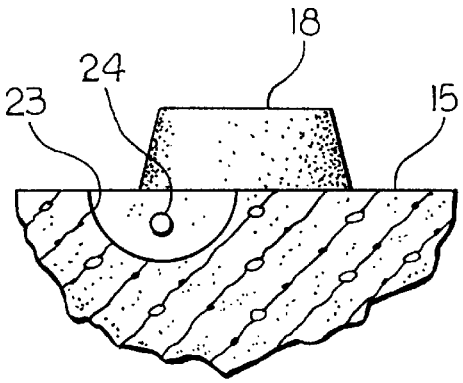
FIG. 4 is a fragmentary cross sectional view taken along line 4—4 of FIG. 3.

A rabbet or groove 17 is formed in the bottom 16 to extend parallel to and slightly to the rear of the front face 11. Two projections or knobs 18 extend above the top 15 either the same distance from the front face 11 as the groove 17 or are slightly stepped back from the front face 11. When two blocks 10 are stacked, a knob 18 on a lower one of the blocks extends into the groove 17 on the adjacent upper block 10 to align the blocks. When the knobs 18 have the same spacing from the front face 11 as the groove 17, the faces of stacked blocks will be vertically aligned. When the knobs 18 are stepped back from the front face 11 further than the groove 17, the front faces 11 of the stacked blocks 10 in adjacent tiers of blocks will have a slope or stepped configuration to provide increased stability in the retaining wall. As shown in FIGS. 1–3, the knobs 18 may be cylindrical or slightly conical with a taper to facilitate removal from a form in which the block 10 is cast and to facilitate stacking the blocks 10. Preferably, the groove 17 has a rear surface 19 which is angled to further facilitate alignment of the blocks 10 when they are stacked to form a retaining wall.

Figure 6:
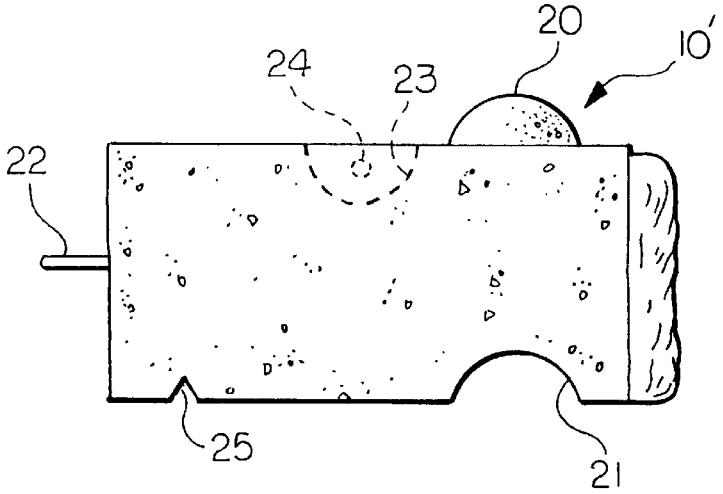
FIG. 6 is a left side elevational view of a modified retaining wall block.

Alternately, rounded or semispherical knobs 20 may be provided and a complementary groove 21 having a rounded cross section may be formed in the bottom of the block 10', as shown in FIG. 6. By rounding the knobs 20 and the groove 21, alignment of the blocks is simplified when the blocks are stacked. Optionally, the groove 17 in the block 10 or the groove 21 in the block 10' can be omitted for blocks which are to be used in the bottom tier of a retaining wall. Also, the knobs 18, 20 may be omitted from blocks 10, 10' which will form the uppermost tier of a retaining wall.

As best illustrated in FIGS. 3–6, two or more lifting points may be provided on the blocks 10, 10'. The blocks 10, 10' are cast in a form with the front face 11 of the blocks 10, 10' located at the bottom of the form and the rear side 12 of the blocks 10, 10' located at the top of the form. A heavy wire lifting loop 22 extends from the rear side 12. The lifting loop 22 may be formed, for example, by a curved piece of rebar deeply embedded into the concrete block. The loop 22 is used to lift the block 10, 10' from the form in which it was cast, since the rear 12 of the block is at the top of the form. When the block 10, 10' is cast, a recess 23 also may be formed in the top 15. A rod 24, for example, a piece of rebar, is embedded into the concrete block 10 to extend across the recess 23. A hook on a chain or cable or other lifting device (not shown) may be attached to the rod 24 for lifting and positioning the blocks 10, 10' when constructing a retaining wall. It should be appreciated that other arrangements also may be used to facilitate lifting and moving the blocks 10, 10'.

The blocks 10, 10' are formed from concrete with a minimum depth between the front 11 and the rear 12. The minimum depth and the size of the blocks are selected to assure that a wall constructed with the blocks 10 will remain stable. For example, concrete blocks 10, 10' have been constructed having a front face 11 about 4 feet wide and 1.5 feet high and a depth of between about 2 feet and 4 feet. The blocks 10 may be sized, for example, to have a weight between about 1000 and 3000 pounds (between about 454 Kg. and 1,361 Kg.) to form a strong, stable retaining wall. The blocks may have a greater depth than the minimum, and the depths of blocks used in constructing a retaining wall need not be identical since the back side of the retaining wall will be back filled with, for example, sand, gravel or dirt. A groove 25 is shown on the top 15 for indicating the minimum acceptable depth when the block 10 is cast. However, the groove or other minimum depth marking may be a visible mark on the form in which the block 10 is cast and not on the cast block 10. If the depth indicator leaves a mark on the block 10, it may be on one or more of the top 15, the bottom 16 and the sides 13 and 14. When concrete is mixed specifically to form the blocks 10, it is only necessary to make the blocks 10 with a depth as indicate by the groove 25. If the blocks 10 are made with concrete left over from another application, the depth of the blocks 10 may vary with the amount of left over concrete. If a concrete truck returns with insufficient concrete to fill the form to the minimum depth mark, pieces of metal rod or wire may be embedded into the first concrete poured into the form so as to extend into additional concrete which finishes the block. This will form a sufficiently strong mechanical connection between the batches of concrete to maintain the integrity of the finished block 10.

Figure 7:
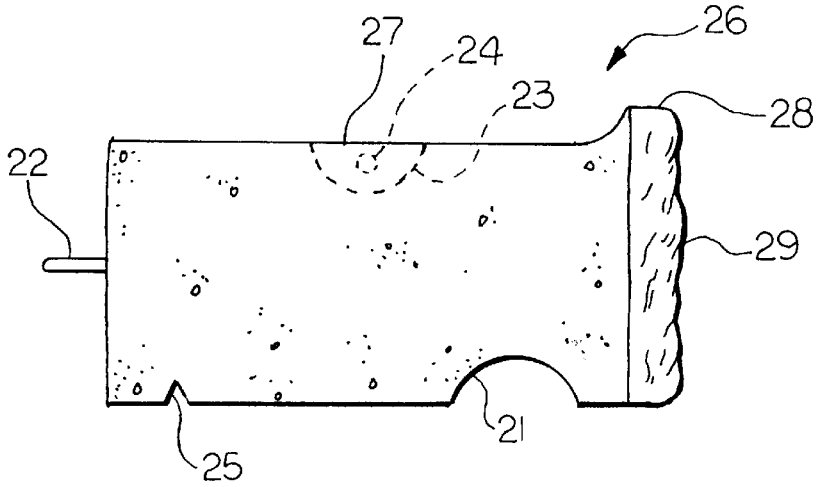
FIG. 7 is a left side elevational view of a further modified retaining wall block.

FIG. 7 shows a modified block 26 which may be used at the top of a retaining wall. The block 26 is formed with a flat top 27 which is recessed below an upper edge 28 of a front face 29 of the block 26. There are no knobs 18 or 20 on the top 27. After a retaining wall is constructed and the blocks 26 are positioned at the top of the wall, back fill is added behind the wall. The top soil, sod or pavement can extended over the top 27 to the upper edge 28 which prevents the soil or other material from washing away. Consequently, grass or other vegetation may be planted up to or pavement may extend up to the front face 29 for finishing the top of the retaining wall. A recess 23 may be formed in the flat top 27 and a rod 24 may be embedded in the block 26 to extend across the recess to form a lifting hook for moving the block 26 similar to the recess 23 and rod 24 shown in FIGS. 1–6. If desired, holes (not shown) may be formed in the block 26 to extend to the flat top 27 for receiving fence posts (not shown). The holes may be either formed in the blocks 26 when they are cast, or drilled at a later time, as needed.

Figure 8:
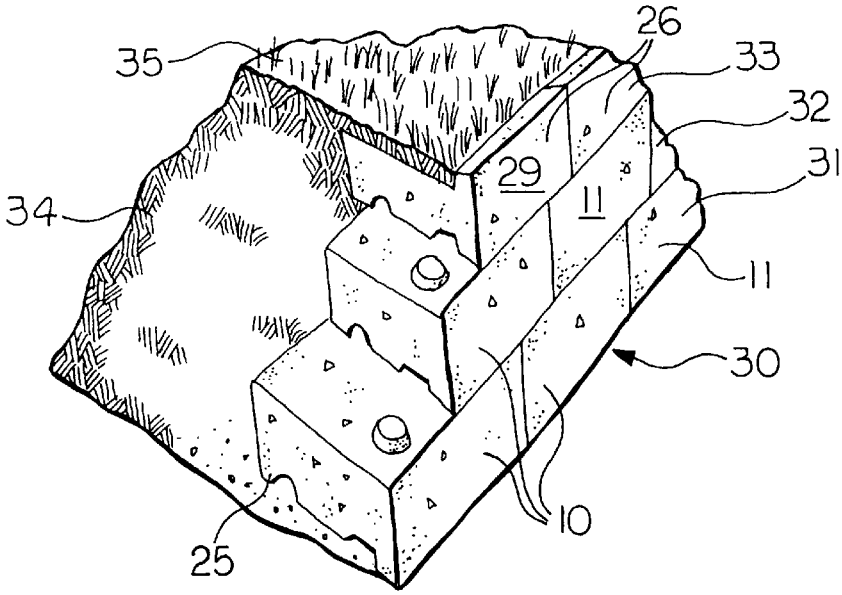
FIG. 8 is a fragmentary perspective view showing a portion of a three tier retaining wall constructed with blocks according to one embodiment of the invention.

FIG. 8 is a perspective view illustrating a fragmentary portion of a retaining wall 30 constructed with concrete blocks 10 according to the invention. The retaining wall 30 is illustrated with three tiers of blocks, a lower tier 31 of blocks 10, a middle tier 32 of blocks 10, and an upper tier 33 of blocks 26. As illustrated, each of the blocks 10, 26 may have a different depth, depending on the amount of concrete available when each block was made. However, the blocks 10, 26 all have at least the minimum acceptable depth as represented by the grooves 25. Although the fragmentary portion of the wall 30 is shown with the fronts 11 of each block arranged in a plane, it will be appreciated that the wall 30 may be constructed with a curved or in a serpentine shape. Dirt, sand and/or gravel 34 is used to back fill behind the wall and sod 35 is shown planted up to the upper edge 28 of the front 29 of the blocks 26 in the upper tier 33. Alternately, gravel or paving or other materials may extend to the upper edge 28 of the front 29 of the blocks 26 in the upper tier 33. When finished, the wall 30 will have a textured, architecturally pleasing face formed by the fronts of the blocks. If desired, the exposed surfaces of the blocks 10, 26 maybe stained, painted or dyed to give a desired finished appearance.

Depending upon the height of the retaining wall and the conditions of the soil on which the retaining wall is constructed, the lower most tier of blocks in the retaining wall may rest either on the soil or on a suitable footer. Where drainage is needed, a porous drain 36 may be installed to extend behind the base of the lowermost tier of blocks in the retaining wall and gravel may be used as backfill immediately behind the retaining wall to eliminate a risk of water draining through cracks between the retaining wall blocks.

Figure 9:
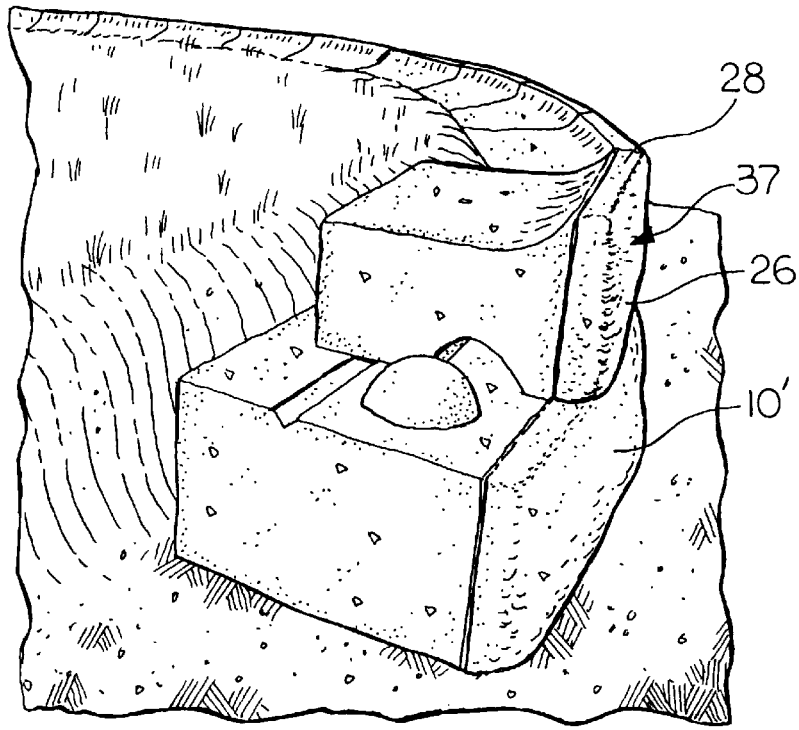
FIG. 9 is a perspective view showing a portion of a two tier retaining wall being constructed with blocks according to a modified embodiment of the invention.

FIG. 9 shows a curved two tier retaining wall 37 being constructed according to a further embodiment of the invention. The lower tier of blocks are similar to the blocks 10', except that the bottom groove 21 has been eliminated. The blocks 26 are used to form the upper tier of blocks on the retaining wall 37. When finished, top soil (not shown) will extend to the upper edge 28 of the upper tier of blocks 26. As illustrated, the blocks in the two tiers are offset so that the cracks between the blocks in the two tiers are offset. It will be understood that half width blocks (not shown) may be formed for use at a free standing end of the wall so that the ends of the tiers are aligned. The retaining wall 37 is provided with a curved shape and may be used, for example, for landscaping at a business. Trees and flowers may be planted in the soil at the top of the wall. Or, the area between two spaced retaining walls may be planted with trees or other vegetation to form a visual or sound barrier.

The retaining wall blocks 10, 10', 26 are manufactured by pouring concrete into a form 40 constructed according to the invention. Details of the form 40 are shown in FIGS. 10–17. The form 40 is illustrated mounted on a base 41 which may consist, for example, of two heavy duty I beams 42 which extend parallel and are connected together by suitable cross members (not shown). The I beams 42 can serve as skids for moving the forms 40. If desired, the base may be sufficiently long to mount two or more of the forms 40. Preferably, a pneumatic or electric vibrator 43 is mounted on the base 41 to vibrate all forms 40 mounted on the base 41 to help remove air bubbles and voids from concrete after it is poured into the forms 40 and to help the concrete to flow into all cavities and crevices in the forms 40.

The form 40 has four side panels 44–47 each of which is mounted on the base 41 to pivot between a closed position for casting a retaining wall block 10 and an open position wherein a hardened retaining wall block 10 may be lifted from the form 40. The side panel 44 forms the top 15 of the block 10, the side panel 45 forms the bottom 16 of the block 10, the side panel 46 forms the side 14 of the block 10, and the side 47 forms the side 13 of the block 10. The sides 44–47 define a cavity 48. The sides 44 and 45 preferably extend parallel to each other, and the sides 46 and 47 preferably form a predetermined angle of less than 90° to the bottom of the cavity 48. Consequently, a block 10 cast in the form will have a trapezoidal shape in plan. The angled sides 13 and 14 permit adjacent blocks 10 forming a retaining wall to be arranged with their faces 11 angled to form a curved or serpentine shape to the retaining wall.

Preferably, a resilient face insert 49 is located at the bottom of the cavity 48 and has a textured surface 50 which is shaped to impart a desired texture or ornamental appearance to the front 11 of the block 10. Thus, retaining wall blocks having different ornamental appearances on their fronts 11 may be formed merely by replacing the resilient face insert 49 with a resilient face insert having the desired configuration on the surface 50. The face insert 49 is preferably made from a resilient material such as from urethane rubber. A frame (not shown) may be embedded in the face insert 49 to provide stability and to provide a means for securing the face insert 49 in the cavity 48. Studs (not shown) may be attached to the frame to extend from a bottom of the face insert 49 for bolting the face insert 49 to the form 40. By securing the face insert 49, the face insert 49 will not be pulled from the form 40 when removing a cast block.

The sides 44–47 of the form 40 each include a metal plate 51, for example, of 0.375 inch (9.5 mm) steel, which forms a side of the cavity 48 and a structural frame 52. The structural frame 52 for each side 44–47 may be, for example, welded from channel members having a square or rectangular cross section and is welded or otherwise secured to a plate 51. Knob formers 53 are bolted, welded or otherwise secured over one or more openings in the plate 51 for the side 44 for forming the knobs 18, 20 on the top 15 of the retaining wall block 10, 10'. A length of angle iron or a half of a pipe may be welded or bolted to a plate 51 to extend horizontally across one or more of the sides 44–47 at a suitable location for serving as a minimum fill indicator 54 for the cavity 48. If a projecting minimum fill indicator 54 is provided, as shown, it will produce the small groove 25 on the block 10. A minimum fill indicator 54 which provides a small rounded groove 25 may make it easier to open the form 40 than one which produces a v-shaped groove 25. It should be apparent that other types of minimum fill indicators 54 also may be used with the form 40 and it is not necessary that they leave a mark on the cast block 10. It is only necessary that the indicator be sufficient to clearly show when a required minimum amount of concrete has been poured into the form 40.

A groove insert 55 is bolted, welded or otherwise secured to extend horizontally across the plate 51 for the wall 45 for forming the groove 17, 21 in the lower surface of the block 10, 10', 26. When the retaining wall is to have a vertical front face, the groove insert 55 is aligned with the knob former 53 so that the fronts of stacked blocks 10, 10' are aligned when the knobs 18, 20 on a lower block 10, 10' are positioned in the groove 17, 21 on an adjacent upper block 10, 10' or 26. It will be appreciated that positioning the groove insert 55 closer to the bottom of the cavity 48 than the knob formers 53 will move the knobs 18, 20 further behind the face 11 than the groove 17, 21. This will cause the front of each successive tier of blocks in the retaining wall to be located behind the front of the adjacent lower tier of blocks to produce a stepped or sloping retaining wall.

When a block 26 for the top of the wall is to be cast, a suitable top block insert (not shown) may be placed adjacent the side 44 of the form 40 for forming the flat top 27 which is recessed below the upper edge 28 of the block face 29. The top block insert will eliminate the knobs 18, 20 from being formed when the block 26 is cast and will form the flat top 27 which is recessed below the upper edge 28 of the front 29 of the block 26. Alternately, the form side 44 may be modified so that a form 40 always forms the blocks 26. As will be discussed below, resilient members may be bolted to the top block former insert for forming a recess 23 and for positioning a lifting rod 24 in the top of the block 26.

Preferably, the face insert 49, the knob formers 53, the groove insert 54, the top block insert, and other form cavity inserts are all releasably attached to the form 40, for example, with bolts. This will permit easy modification of the setup of the form 40 for casting different types of retaining wall blocks. Alternately, the inserts may be permanently attached to the form so that the form is suitable for manufacturing only one type of retaining wall block.

Figure 10:
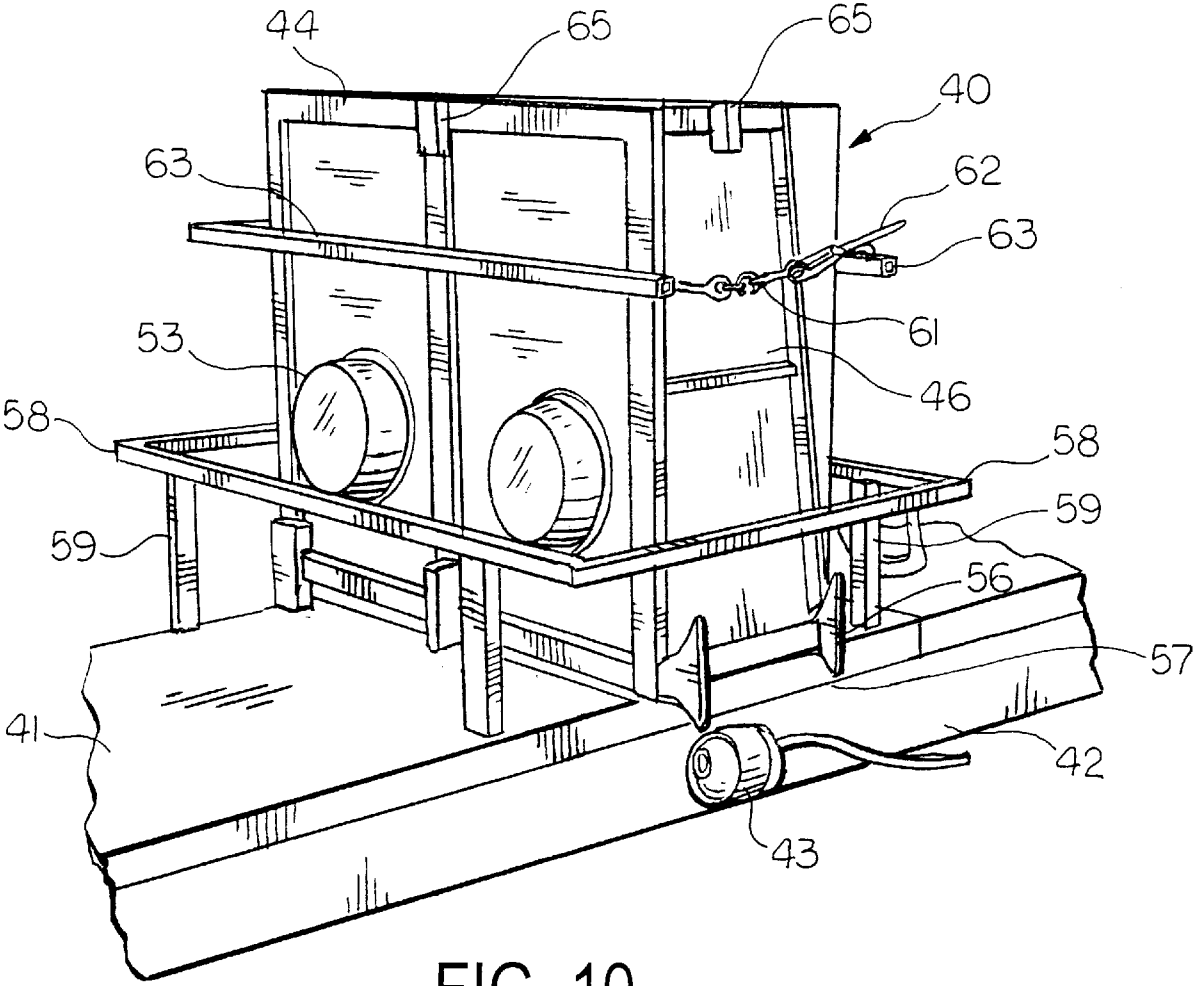
FIG. 10 is a perspective view of a form according to a first embodiment of the invention for manufacturing concrete retaining wall blocks, with the form shown closed for casting a block.
Figure 11:
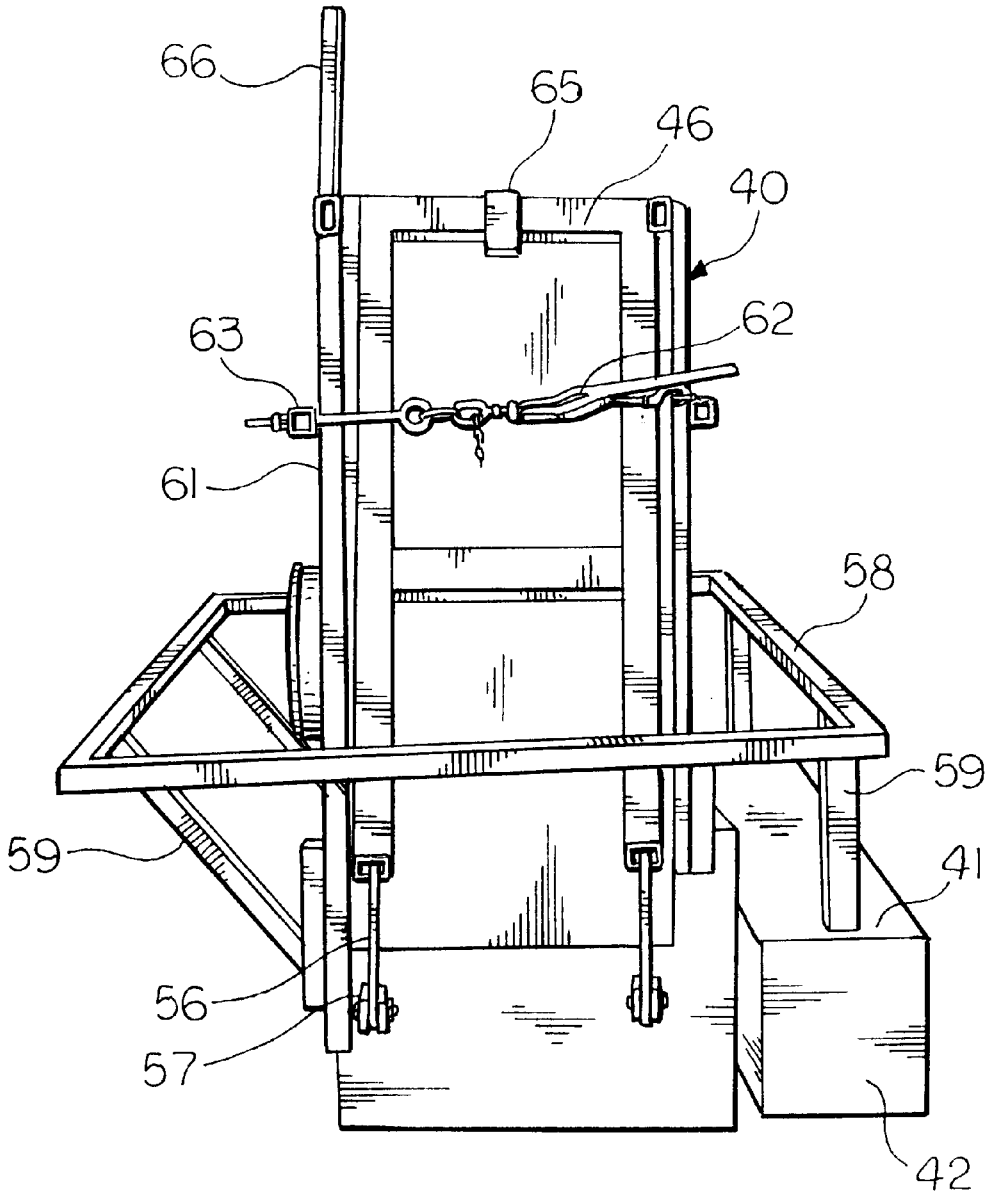
FIG. 11 is an end view of the closed form of FIG. 10.
Figure 12:
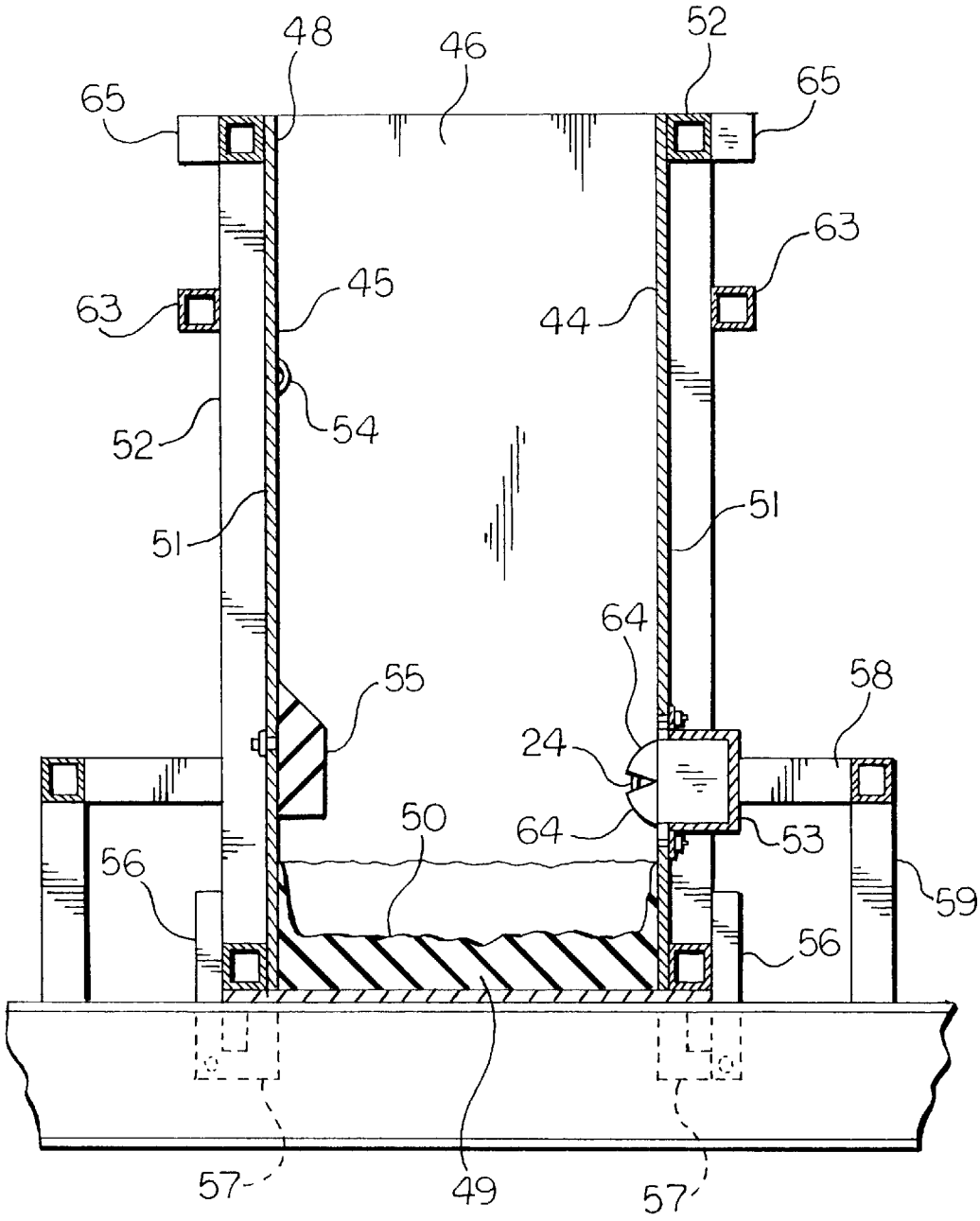
FIG. 12 is a fragmentary cross sectional side view as taken along line 10—10 through the form of FIG. 10.
Figure 15:
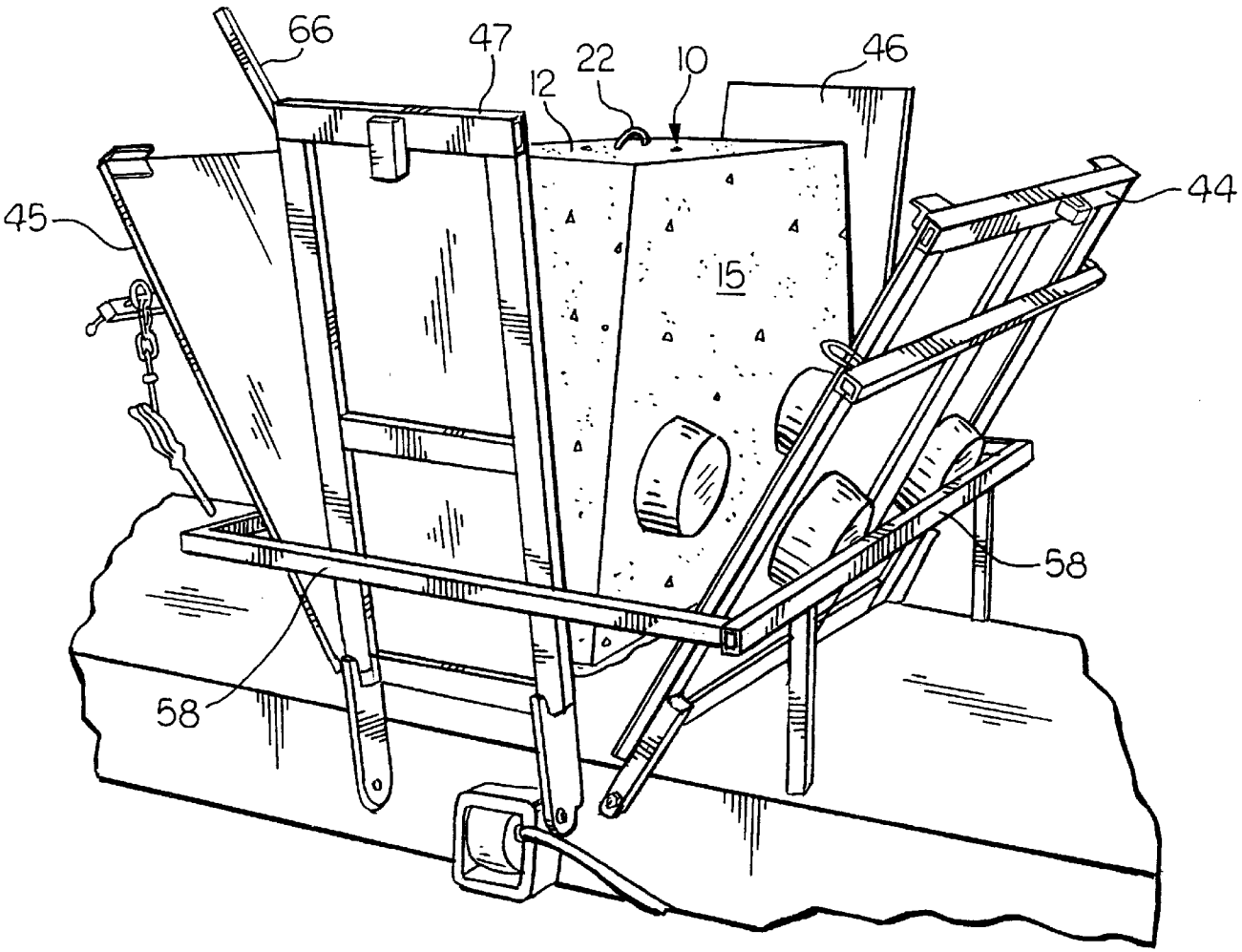
FIG. 15 is a perspective view showing the form of FIG. 10 in an open position.

Each of the sides 44–47 is mounted to pivot on the base 41 between an open position to facilitate removal of a previously cast block 16, 10', 26 and a closed position for forming the cavity 48 in which a block 10, 10', 26 is cast. As shown in FIGS. 10–12, brackets 56 are secured to and extend below the structural frame 52 for each side 44–47. Two brackets 56 are illustrated on each side frame 52. One of the brackets 56 is located adjacent each lower corner or each side frame 52. The brackets are secured with bolts to rotate on brackets 57 secured to the base 41 to allow the sides 44–47 to pivot. By positioning the pivots below the cavity 48, the sides 44–47 will pivot further away from the face insert 49 when the form 40 is open. This allows for easy cleaning of the sides 44–47 and allows any debris to fall clear of the face insert 49. A fence or rail 58 is attached to posts 59 which are secured to the base 41. The rail 58 extends around the form 40 and is spaced from the form 40 when it is in its closed position. When the sides 44–47 are pivoted to the open position, they rest on the rail 58 which limits the distance that the sides 44–47 can pivot, as shown in FIG. 15.

A socket 65 may be secured to the upper center region of each side frame 52 to facilitate opening the form 40. A bar 66 (FIG. 15) is inserted into the socket 65 to provide leverage in prying the sides 44–47 to the open position after a block 10, 10' is cast. The bar 66 may be moved from side to side as the form 40 is opened. For large blocks 10, 10', the bar 66 may be hit with a hammer or moved, for example, with the aid of a backhoe or forklift to pry open the form 40, breaking any bond between the hardened concrete and the form sides 44–47.

Figure 13:
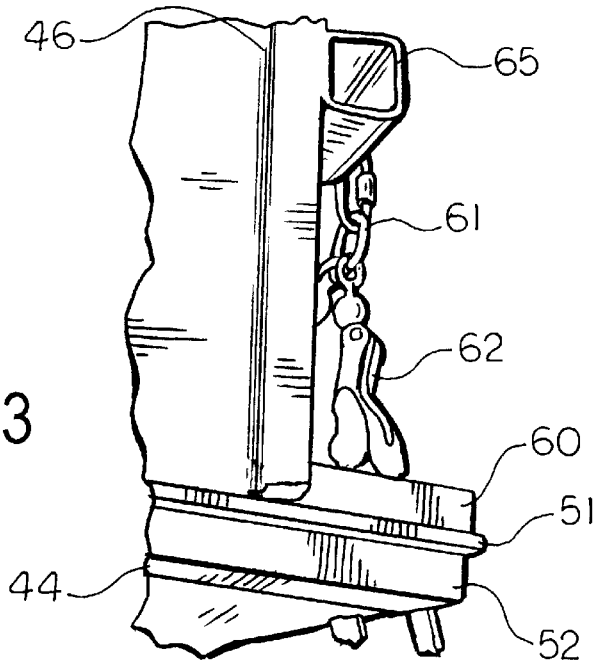
FIG. 13 is a fragmentary top plan view showing details of a mechanism for locking the form sides together in the closed position.
Figure 14:
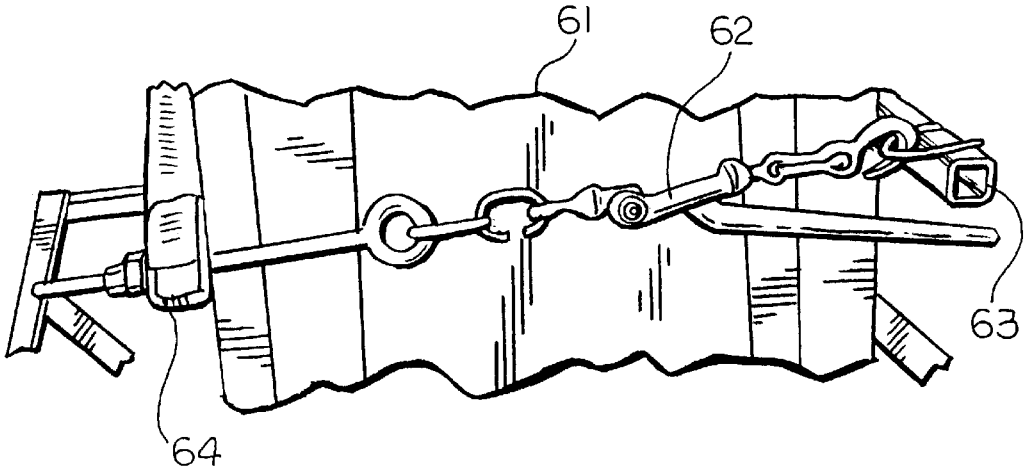
FIG. 14 is a fragmentary side elevational view showing further details of the mechanism of FIG. 12 for locking the form sides together.

Prior to casting a block 10, the sides 44–47 of the form 40 are pivoted to a closed position, as shown in FIGS. 10–12. The form sides 46 and 47 which form the sides 14 and 13 of the block 10 are first pivoted to the closed position. When the sides 44 and 45 are subsequently pivoted to the closed position, stop members 60 (FIG. 13) on the sides 44 and 45 engage the sides 46 and 47 to restrain the sides 46 and 47 from pivoting. As illustrated in FIGS. 10, 13 and 14, locking mechanism, such as a chain 61 and a load binder 62, are then secured between ends of channels 63 on the sides 44 and 45 adjacent each side 46 and 47 to restrain the sides 44 and 45 from pivoting. The load binder 62 can be moved between a latched position wherein the sides 44 and 45 are held tightly against the sides 46 and 47, and a released position wherein each chain 61 and the load binder 62 may be unhooked from the channel 63 on at least one of the sides 44 and 45 to permit opening the form 40. The load binder 62 is a cam mechanism which takes up slack in the chain 61 to prevent movement of the sides 44 and 45. It will be appreciated that other well known types of releasable locking mechanisms may be used to rigidly hold the sides 44–47 in a closed position. For example, rods (not shown) may be mounted on the ends of one of the channels 63 for pivoting to a position wherein they engage the ends of the other channel 63. A threaded fastener or a cam mechanism may be provided on the rods for tightening the sides 44 and 45 against the sides 46 and 47. Or, each rod may simply hook over the opposite channel 63.

Either prior to closing the form 40 or after the form 40 is closed, it may be desirable to coat the interior surfaces of the cavity 48 with a suitable concrete release agent to facilitate opening the form 40 after a block has been cast and hardened. Various release coatings are well known for use in forms used to cast concrete products. It also may be desired to apply a dye or coating to the surface of the face insert 49 which form the face of the cast blocks. A dye or coating is selected to stain or coat the front face of the blocks which is exposed in a retaining wall built with the blocks to provide a desired finished appearance.

Figure 5:
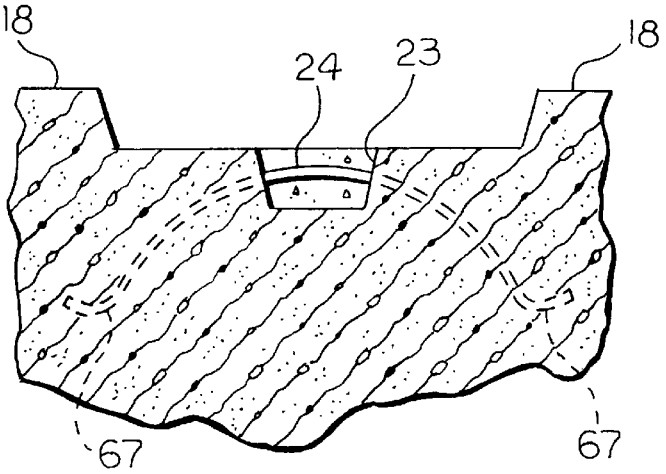
FIG. 5 is a fragmentary cross sectional view taken along line 5—5 of FIG. 3.
Figure 16:
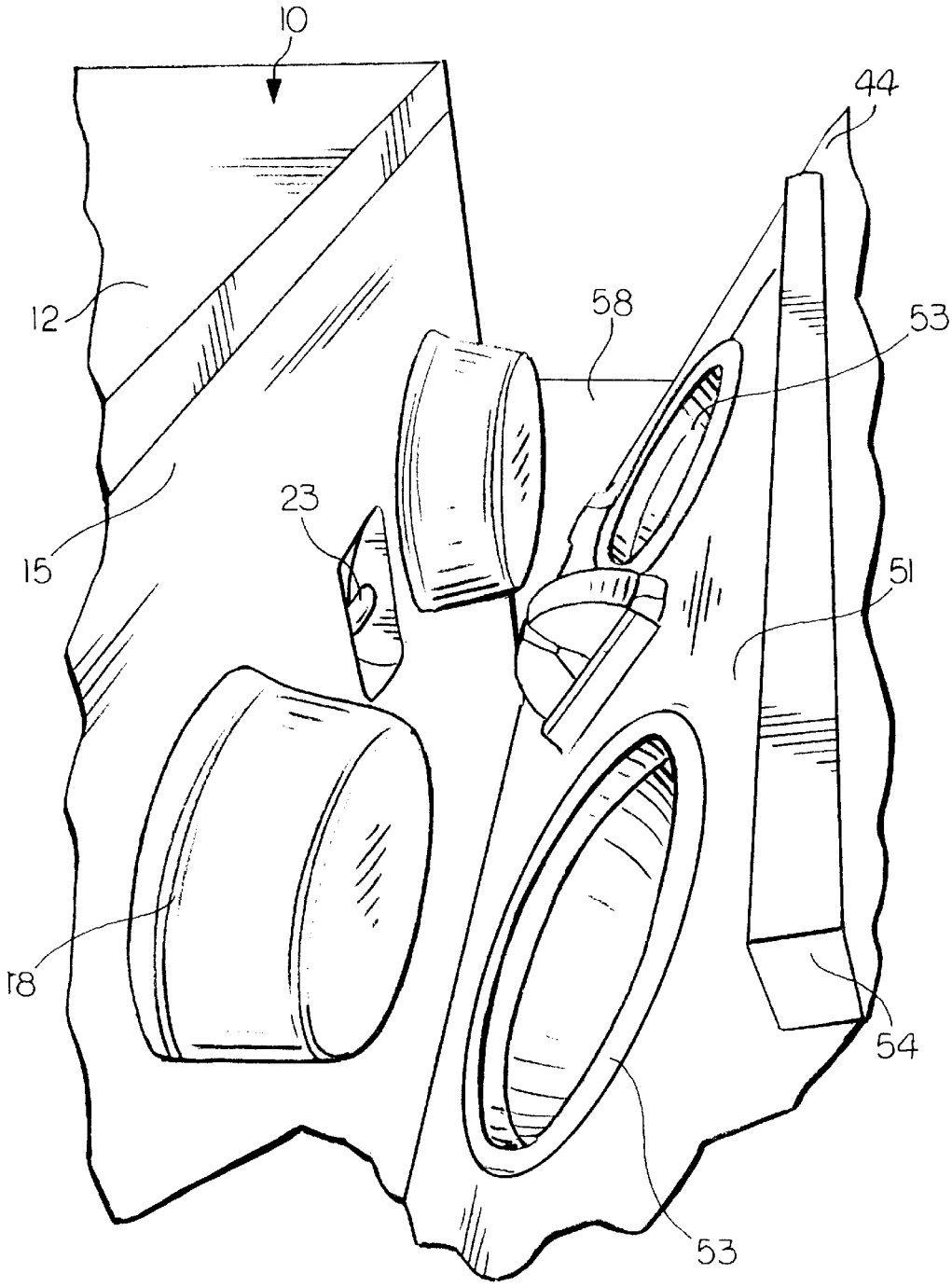
FIG. 16 is a fragmentary perspective view showing the side of the form which casts the top of the retaining wall block pivoted to an open position away from a cast retaining wall block.
Figure 17:
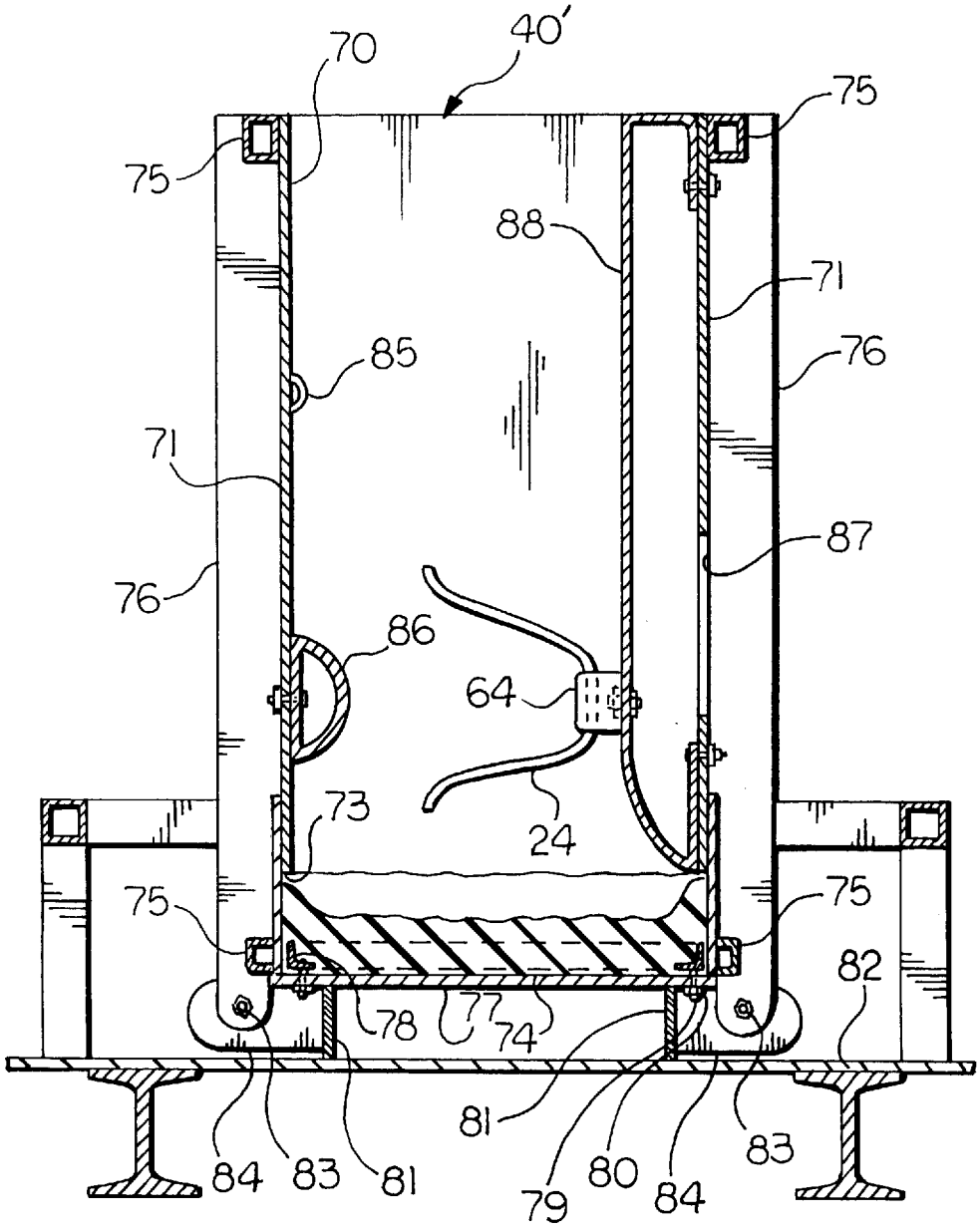
FIG. 17 is a form for casting a concrete retaining wall block according to a modified embodiment of the invention.

FIGS. 15 and 16 shows the form side 44 pivoted away from the cast block 10. The side 44 is pivoted clear of the knobs 18 on the top 15 of the block 10 to permit lifting the block 10 vertically from the open form 40, using the lifting loop 22. One or two resilient members which comprise a lift hook recess forming insert 64 are mounted on the side 44 between the knob formers 53 as shown in FIGS. 12, 16 and 17. The lift hook recess forming insert 64 is formed from a resilient material such as a polyurethane rubber for molding the recess 23 in the block 10 between the knobs 18. The Prior to closing the cavity, the rod 24 (shown in FIGS. 1, 3, 4, 5 and 12) is inserted between the members of the lift hook recess forming insert 64 and is held in place through its resiliency. The rod 24 may be, for example, a length of rebar. Preferably, the rod 24 is bent as shown in FIG. 5 with hooked ends 67 which are deeply embedded in the block 10, 10', 26 to prevent the rod 24 from pulling away when lifting the heavy block. The rod 24 is positioned so that it extends across the recess 23 and can be engaged with a suitable lifting hook. When the form 40 is opened after the block 10 is cast, the rod 24 remains embedded in the block 10 to extend across the recess 23, forming a recessed lifting point on the block 10. The lift hook recess forming insert 64 may be oriented as illustrated, or it may be rotated 90° so that the rod 24 extends between the front and back of the block.

Figure 18:
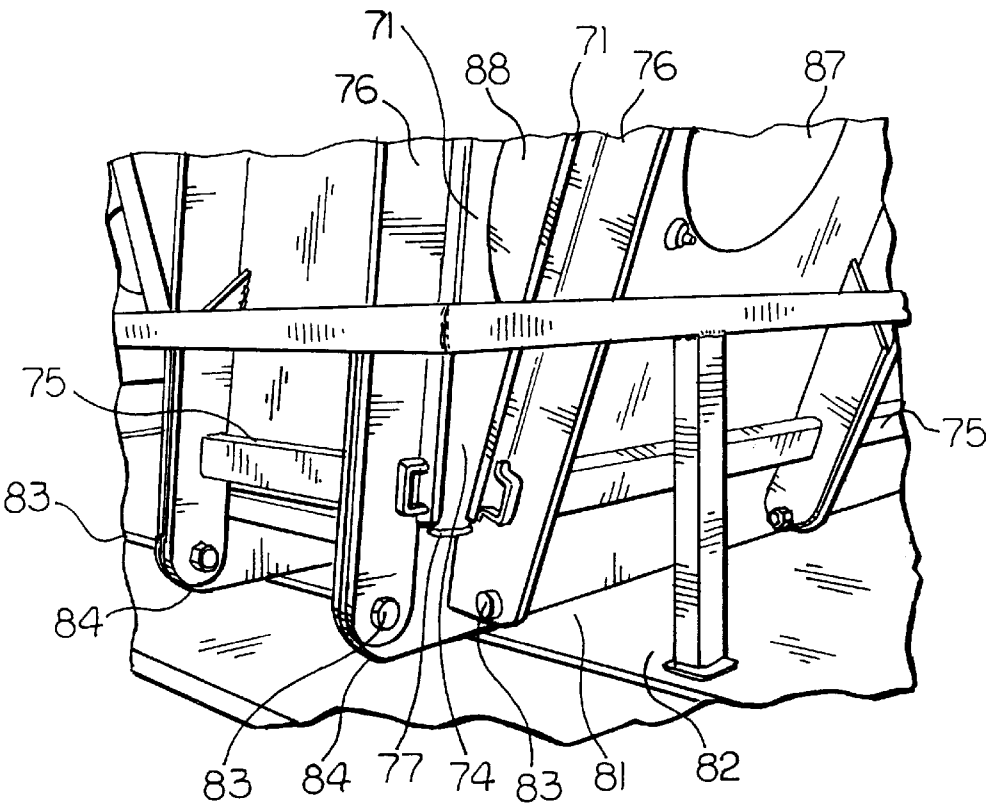
FIG. 18 is an enlarged fragmentary perspective view showing details of the form of FIG. 17.

FIG. 17 is a cross sectional view through a modified form 40' according to a further embodiment of the invention and FIG. 18 shows detains for hinging the sides of the form 40' for pivoting between closed and open positions. The form 40' is made from aluminum and includes a cavity 70 having sides formed from aluminum plates 71. An extension plate 72 is welded to the bottom of each plate 70 to form a shallow step 73 which receives a resilient face insert 74. Channels 75 are welded across the top of the plate 71 and across the bottom of the plate 72 and vertical bars 76 are welded along the side edges of the plates 71 to prevent distortion of the plates 71. For the larger plates 71 which form the top and bottom of the cast blocks, one or more additional bars 76 also may be welded to the plates 71 to extend vertically at locations between the sides of the plates 71, as needed to provide the required strength.

The resilient face insert 74 is supported on a lower panel 77. An angle iron frame 78 is embedded in the face insert 74 and studs 79 secured to the frame 78 project below the face insert 74 through the lower panel 77 where they are secured with nuts 80. The lower panel 77 is mounted on bars 81 which are supported on a base 82. The bars 76 on the plates 71 extend below the lower panel 77 and are secured with bolts 83 to pivot on brackets 84 secured to the bars 81.

In the illustrated form 40', a small rounded channel 85 is welded to extend horizontally across the plate 71 which forms the bottom of a cast block to indicate a minimum fill level for the cavity 70. A groove forming insert 86 also is secured to extend horizontally across the plate which forms the bottom of the block for forming the bottom groove 17, 21. The illustrated groove forming insert 86 forms a rounded groove in the bottom of the cast block, such as the groove 21 for the block 10' of FIG. 6.

The plate 71 which forms the top of the cast block has one or more openings 87 in which one or more knob formers (not shown) are bolted. In the illustrated embodiment, the knob former is omitted and a top block former 88 is bolted to the plate 71. The top block insert 88 forms the recessed flat top 27 of the blocks 26 used to form the top of a retaining wall. A lift hook recess forming insert 64 is bolted to the top block insert 88 to form a groove 23 and to position a rod 24 in the groove for creating a lifting point on the top surface 27 of the block 26. Although the form 40' is set for casting top blocks 26, it may be converted for forming the lower blocks 10, 10' by removing the top block insert 88, and securing the lifting hook recess forming insert 64 and one or more suitable knob formers to the side 71.

According to a further aspect of the invention, the form 40' may be easily modified to cast various types of blocks. FIGS. 19–23 show the form 40' with inserts installed for manufacturing two half width top tier blocks. FIG. 20 shows a fragmentary portion of the form 40' in the closed position, and FIGS. 21–23 show fragmentary portions of the form 40' in the open position. A modified face insert 92 (FIG. 23) is placed in the bottom of the form 40' for defining the textured faces of each of the two half blocks.

A half block insert 93 is mounted of the side 45' of the form 40' which defines the bottom of a cast retaining wall block. The half block insert 93 is generally wedge shaped, having a wide top 95 and a narrow bottom 96. When the form 40' is closed, the narrow bottom 96 abuts a partition 97 (FIG. 23) in the face insert 92 to separate the form 40' into two half block cavities 98 and 99 (FIG. 20). The half block insert 93 has a side 100 which is shaped to conform with the form side 45', and any other inserts attached to the form side 45'. As illustrated, the half block insert 93 has a semicircular area 101 which conforms with the groove forming insert 86. If the form 40' is configured without the groove forming insert 86, for example, to form a block for the bottom tier of a retaining wall, a half block insert without the semicircular area 101 is used.

The half block insert 93 may be releasably secured to the form side 45' by any convenient method, such as with bolts, hooks or other releasable clamps. The illustrated half block insert 93 is provided with a pair of hooks 102 which hook over an upper edge 103 of the form side 45'. In addition at least one bolt 104 may be secured to project from the half block insert side 100 for passing through aligned holes (not shown) in the form side 45' and securing with nuts 105 (FIG. 20). A lifting eye 106 is attached to the top 95 of the half bottom insert 93 to facilitate attaching the insert 93 to and removing the insert 93 from the form 40'.

Figure 19:
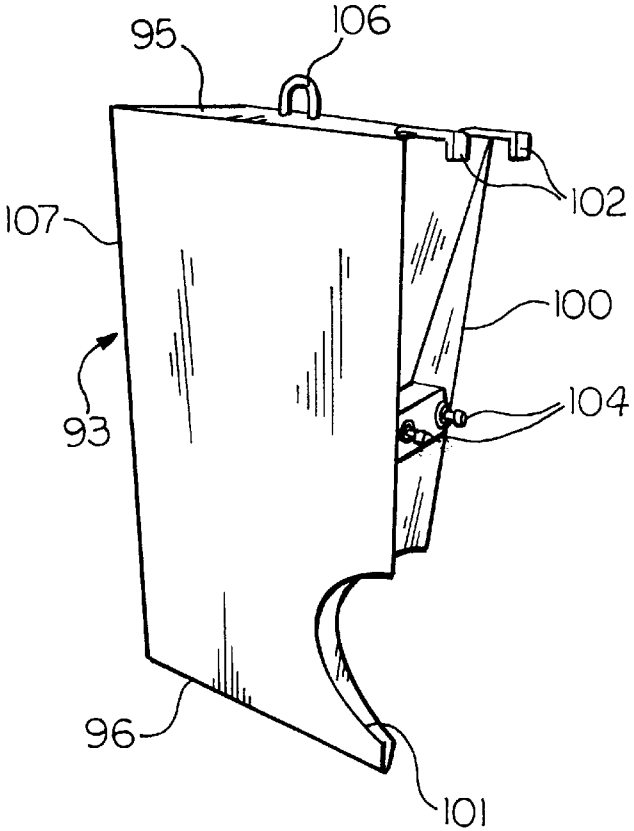
FIG. 19 is a side perspective view showing details of a half block divider insert.
Figure 20:
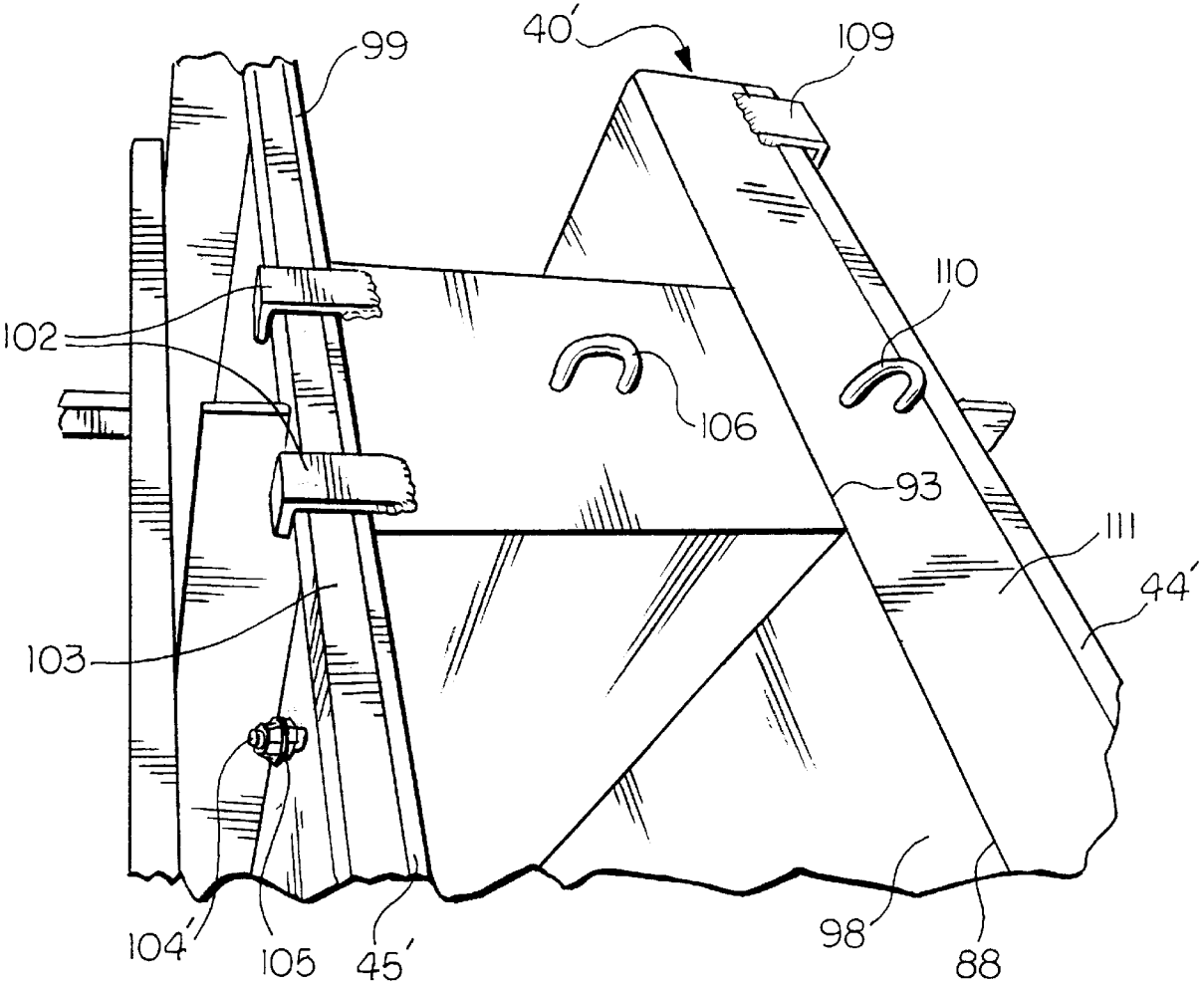
FIG. 20 is a top perspective view of a form according to a further embodiment of the invention with a half block insert attached to one side of the form and a top block insert attached to an opposite side of the form.
Figure 21:
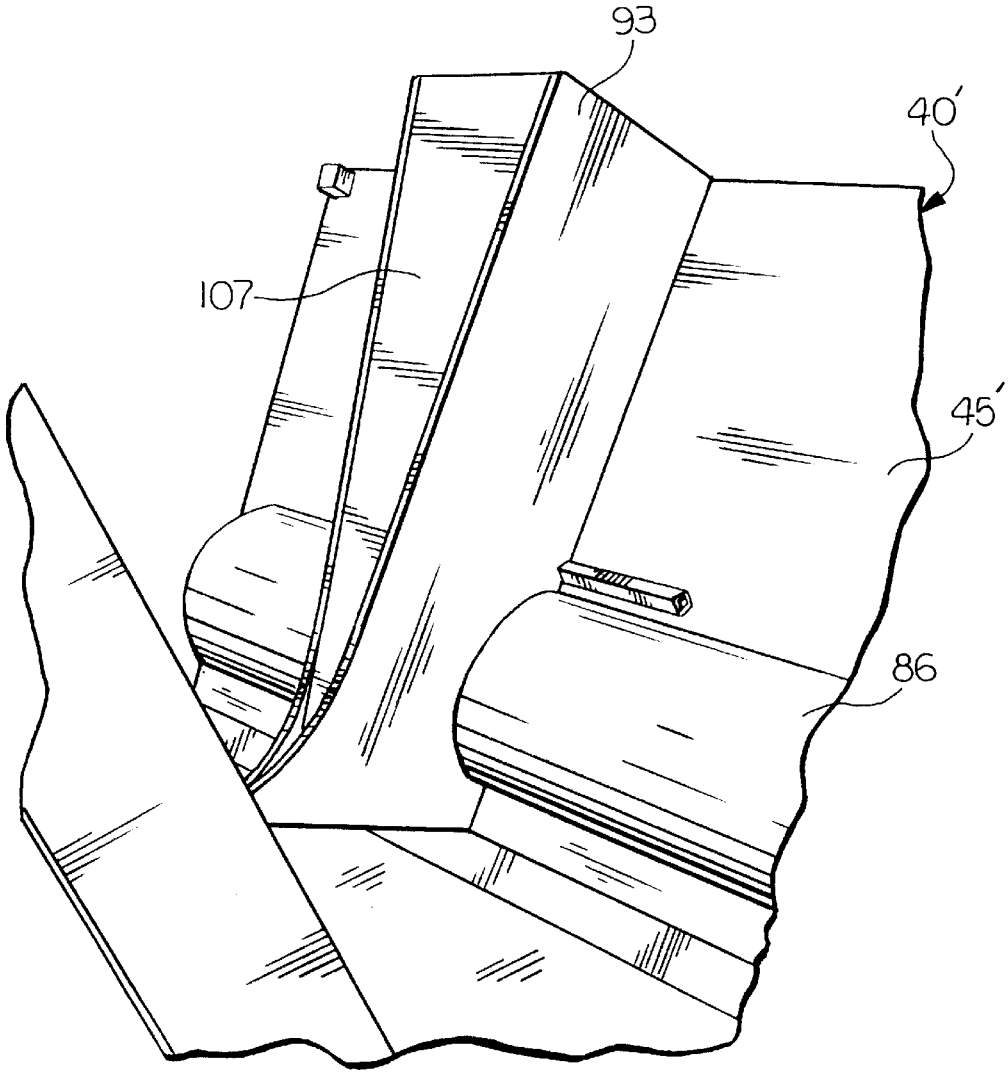
FIG. 21 is a perspective view showing a fragmentary portion of the form of FIG. 20 open and showing details of the half block insert attached to a side of the form.
Figure 22:
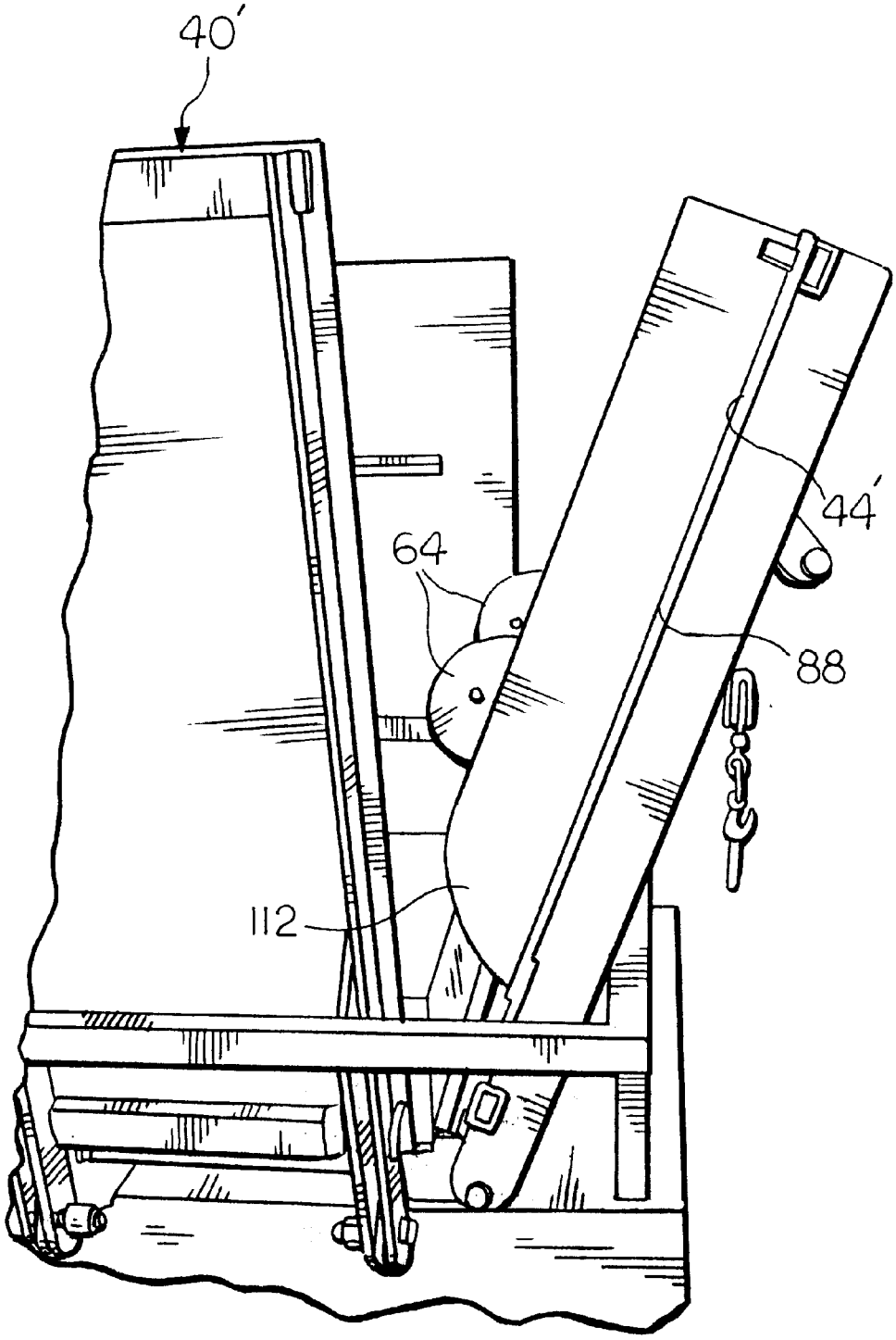
FIG. 22 is a side elevational showing a fragmentary portion of the form of FIG. 20 open and showing details of the top block insert attached to a side of the form.
Figure 23:
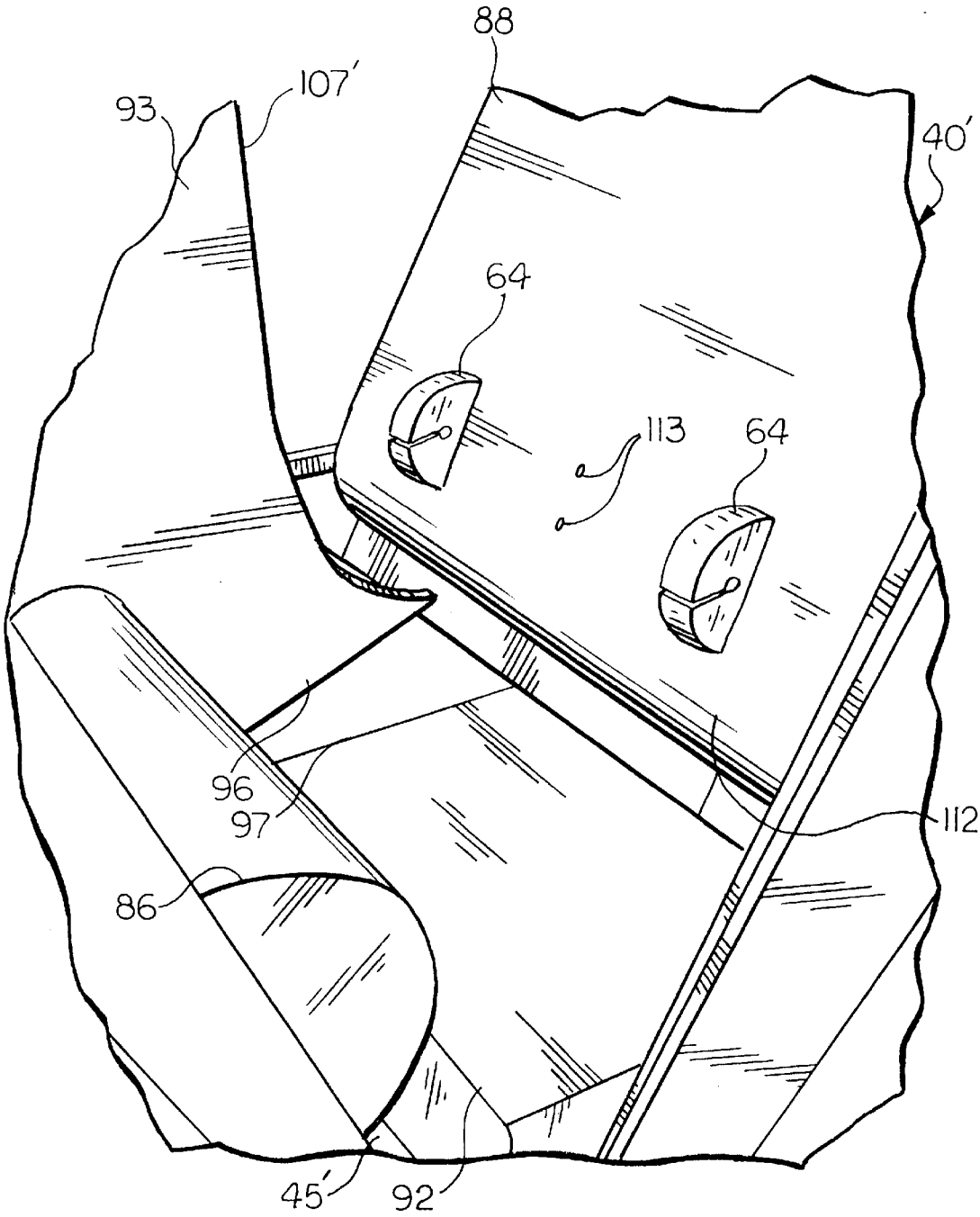
FIG. 23 is a perspective view showing a further fragmentary portion of the form of FIG. 20.

It will be noted that there are differences between the half block insert 93 shown in FIG. 19 and the half block insert 93 shown in FIGS. 20–23. As shown in FIG. 19, the half block insert 93 has a flat side 107 for abutting the flat side 44'of the form 40' opposite the side 45'. This produces half width retaining wall blocks, each having a single knob 18, 20 (FIGS. 1–6). The form 40' in FIGS. 20–23 is set up for forming half width top blocks. A top block insert 88 is releasably secured to the form side 44' with a plurality of top hooks 109 and bolts (not shown) in a manner similar to the method that the half block insert 93 is releasably attached to the form side 45'. A lifting eye 110 is attached to a top 111 of the top block insert 88. The Top block insert 88 has a rounded or curved lower edge which in cooperation with the face insert 90 forms the upper edge 28 of the top block. Two lift hook recess forming inserts 64 are shown bolted or otherwise attached to the top block insert 88. The lift hook recess forming inserts 64 are located on the top block insert 88 so that a lifting hook recess 23 and a lifting hook rod 24 is centered in the blocks formed in each cavity 98 and 99. When the form 40' is used for casting a full size top block, only a single lift hook recess forming insert 64 is attached to the top block insert 88 at the holed 113.

When the half block insert 93 and the top block insert 88 are both used, the half block insert 93 has a shorter depth and has its side 107' shaped to abut and conform to the top block insert 88, as shown in FIGS. 20–23. Thus, the side 107' of the half block insert 93 has a curved lower end 114 which conforms to the curved lower end 112 of the top block insert 88. Since the curved lower end 114 of the half block insert 93 will extend below the curved lower end of the top block insert 88 when the form 40' is closed, it is necessary to open the form side 44' prior to opening the form side 45' after a half block is cast.

Other inserts also may be used with the forms 40, 40' to provide various configurations for the cast blocks. For example, an insert (not shown) may be provided for securing to one of the side 46 or 47 of the form 40 to form a side on a cast block which is perpendicular to the face of the block. These blocks may be used, for example, at the end of a retaining wall. The insert may include a resilient textured surface similar to the texture of the front face of the block for imparting an aesthetically pleasing appearance to sides of the blocks which will be exposed at the end of a wall. Also, inserts may be provided for casting half top blocks, as shown in FIGS. 20–24 with one side perpendicular to the front face and textured to form a half block suitable for use at the end of a retaining wall.

It will be appreciated that various modifications and changes may be made to the above described preferred embodiments of retaining wall blocks and of forms for manufacturing the retaining wall blocks without departing from the scope of the following claims.

What is claimed is:

1. A form for casting a concrete retaining wall block having a front, a top, a bottom, two sides and a rear, said form including a base, four form sides mounted to pivot relative to said base between closed and open positions, said four form sides forming a cavity having an open top and a closed bottom, said bottom forming the front of a block cast in said cavity, a first of said form sides forming a top of a block cast in said cavity, a second of said form sides forming a bottom of a block cast in said cavity, a third of said form sides forming one side of a block cast in said cavity, and the fourth of said form sides forming the other side of a block cast in said cavity, and a locking mechanism adapted to releasably lock said form sides in said closed position, and including a resilient face insert in said cavity supported on said base, said resilient face insert having a surface defining said cavity bottom and adapted to form a front on a retaining wall block cast in said cavity.

2. A form for casting a concrete retaining wall block, as set forth in claim 1, and wherein said resilient face insert surface is configured to impart a predetermined ornamental appearance to the front of a retaining wall block cast in said cavity.

3. A form for casting a concrete retaining wall block, as set forth in claim 1, and wherein said four form sides are mounted to pivot relative to said base from a point below and away from said face insert whereby said sides move away from said face insert when pivoted to the open position whereby any debris on said sides falls away from said face insert.

4. A form for cast a concrete retaining wall block, as set forth in claim 1, and further including a half block insert mounted on said second form side, said half block insert separating said form cavity into two cavities, each of said two cavities being adapted for casting a half width retaining wall block, and wherein said face insert has surfaces for forming the front of retaining wall blocks cast in each of said two cavities.

5. A form for casting a concrete retaining wall block, as set forth in claim 2, and further including a minimum fill indicator in said cavity located to indicate a minimum acceptable depth to a block cast in said cavity.

6. A form for casting a concrete retaining wall block, as set forth in claim 5, and wherein said minimum fill indicator comprises a raised ridge in said cavity extending horizontally across at least one of said form sides.

7. A form for casting a concrete retaining wall block, as set forth in claim 2, and further including stop members on said first and second form sides located to prevent said third and fourth form sides from pivoting when said form sides are in said closed position, and at least one releasable locking mechanism adapted to extend between and engage said first and second form sides when in said closed position, said locking mechanism preventing said first and second form sides from pivoting when said locking mechanism engages said first and second form sides.

8. A form for casting a concrete retaining wall block, as set forth in claim 7, and wherein said first and second form sides are parallel when in said closed position, and wherein said third and fourth form sides each form an angle of less than 90° to said base in said cavity.

9. A form for casting a concrete retaining wall block having a front, a top, a bottom, two sides and a rear, said form including a base, four form sides mounted to pivot relative to said base between closed and open positions, said four form sides forming a cavity having an open top and a closed bottom, said bottom forming the front of a block cast in said cavity, a first of said form sides forming a top of a block cast in said cavity, a second of said form sides forming a bottom of a block cast in said cavity, a third of said form sides forming one side of a block cast in said cavity, and the fourth of said form sides forming the other side of a block cast in said cavity, and a locking mechanism adapted to releasably lock said form sides in said closed position, and including a rail mounted on said base to surrounding said form sides, and wherein said form sides are spaced from said rail when in said closed position and abut said rail when in said open position.

10. A form for casting a concrete retaining wall block having a front, a top, a bottom, two sides and a rear, said form including a base, four form sides mounted to pivot relative to said base between closed and open positions, said four form sides forming a cavity having an open top and a closed bottom, said bottom forming the front of a block cast in said cavity, a first of said form sides forming a top of a block cast in said cavity, a second of said form sides forming a bottom of a block cast in said cavity, a third of said form sides forming one side of a block cast in said cavity, and the fourth of said form sides forming the other side of a block cast in said cavity, and a locking mechanism adapted to releasably lock said form sides in said closed position, and wherein said first side includes at least one knob former for forming at least one raised knob on the top surface of a block cast in said cavity.

11. A form for casting a concrete retaining wall block, as set forth in claim 10, and wherein said first side includes two spaced knob formers aligned parallel to and spaced from said cavity bottom, said knob formers forming at least two raised knobs on the top surface of a block cast in said cavity.

12. A form for casting a concrete retaining wall block, as set forth in claim 11, and further including a resilient lift hook recess forming insert mounted on said first side between said knob formers, said lift hook recess forming insert having a groove adapted for engaging and resiliently holding a rod which is to be embedded in a block cast in said form, said lift hook recess forming insert forming a recess in the top of a block cast in said cavity and positioning such rod in such block to extend across such recess.

13. A form for casting a concrete retaining wall block, as set forth in claim 11, and further including a groove former secured to said second side to extend between said third and fourth sides adapted to form a groove extending across the bottom surface of a block cast in said cavity, and wherein said groove former is spaced from said cavity bottom the same distance as said knob formers.

14. A form for casting a concrete retaining wall block having a front, a top, a bottom, two sides and a rear, said form including a base, four form sides mounted to pivot relative to said base between closed and open positions, said four form sides forming a cavity having an open top and a closed bottom, said bottom forming the front of a block cast in said cavity, a first of said form sides forming a top of a block cast in said cavity, a second of said form sides forming a bottom of a block cast in said cavity, a third of said form sides forming one side of a block cast in said cavity, and the fourth of said form sides forming the other side of a block cast in said cavity, and a locking mechanism adapted to releasably lock said form sides in said closed position, and further including a resilient lift hook recess forming insert mounted on said first side, said lift hook recess forming insert having a groove adapted for engaging and resiliently holding a rod which is to be embedded in a block cast in said form, said lift hook recess forming insert forming a recess in the top of a block cast in said cavity and positioning such rod in such block to extend across such recess.

15. A form for casting a concrete retaining wall block having a front, a top, a bottom, two sides and a rear, said form including a base, four form sides mounted to pivot relative to said base between closed and open positions, said four form sides forming a cavity having an open top and a closed bottom, said bottom forming the front of a block cast in said cavity, a first of said form sides forming a top of a block cast in said cavity, a second of said form sides forming a bottom of a block cast in said cavity, a third of said form sides forming one side of a block cast in said cavity, and the fourth of said form sides forming the other side of a block cast in said cavity, and a locking mechanism adapted to releasably lock said form sides in said closed position, and further including a top block insert mounted on said first form side, said top block insert forming a top surface which is recessed below an upper edge of a front of a block cast in said form cavity.

16. A form for casting a concrete retaining wall block, as set forth in claim 15, and further including at least one resilient lift hook recess forming insert mounted on said top block insert, said lift hook recess forming insert having a groove adapted for engaging and resiliently holding a rod which is to be embedded in a block cast in said form, said lift hook recess forming insert forming a recess in the top of a block cast in said cavity and positioning such rod in such block to extend across such recess.

17. A form for cast a concrete retaining wall block, as set forth in claim 16, further including a half block insert mounted on said second form side, said half block insert separating said form cavity into two cavities, each of said two cavities being adapted for casting a half width retaining wall block.

18. A form for cast a concrete retaining wall block, as set forth in claim 17, and wherein two resilient lift hook recess forming inserts are mounted on said top block insert, one for forming a recess in the top of a half block cast in each of said two cavities and for positioning a rod in each such block to extend across such recess.

19. A form for casting a concrete retaining wall block having a textured front, a top, a bottom, two sides and a rear, said form including a base, four form sides mounted to pivot relative to said base between closed and open positions, said four form sides when in said closed position forming a cavity having an open top, an insert forming a closed bottom to said cavity, said insert having a textured surface forming a side of said cavity and adapted for forming the textured front of a block cast in said cavity, a first of said form sides forming a top of a block cast in said cavity, a second of said form sides forming a bottom of a block cast in said cavity, a third of said form sides forming one side of a block cast in said cavity, and a fourth of said form sides forming the other side of a block cast in said cavity, and a locking mechanism adapted to releasably lock said form sides in said closed position.

20. A form for casting a concrete retaining wall block having a textured front, a top, a bottom, two sides and a rear, as set forth in claim 19, and wherein said insert is releasably secured at the bottom of said cavity.

21. A form for casting a concrete retaining wall block having a textured front, a top, a bottom, two sides and a rear, as set forth in claim 20, and wherein said insert is releasably secured to said form base.

22. A form for casting a concrete retaining wall block having a textured front, a top, a bottom, two sides and a rear, as set forth in claim 19, and further including a stop for limiting pivotal movement of said form sides when in said open position.

* * * * *